United States Patent [19]

Collonia

[11] Patent Number: 4,616,613

[45] Date of Patent: Oct. 14, 1986

[54] DEVICE FOR ELECTRIC REGULATION OF IDLE OF INTERNAL COMBUSTION ENGINES

[75] Inventor: Harald Collonia, Glasshütten, Fed. Rep. of Germany

[73] Assignee: VDO Adolf Schindling AG, Frankfurt am Main, Fed. Rep. of Germany

[21] Appl. No.: 696,126

[22] Filed: Jan. 29, 1985

[30] Foreign Application Priority Data

Feb. 3, 1984 [DE] Fed. Rep. of Germany ..... 3403750

[51] Int. Cl.[4] ..... F02M 3/07

[52] U.S. Cl. ..... 123/339; 123/352

[58] Field of Search ..... 123/339, 352, 585

[56] References Cited

U.S. PATENT DOCUMENTS

| | | | |
|---|---|---|---|
| 4,441,471 | 4/1984 | Kratt et al. | 123/339 |
| 4,471,735 | 9/1984 | Collonia | 123/352 X |
| 4,513,711 | 4/1985 | Braun et al. | 123/339 |

*Primary Examiner*—Tony M. Argenbright

*Attorney, Agent, or Firm*—Martin A. Farber

[57] ABSTRACT

In a device for electrically controlling the idling of internal combustion engines having a speed-of-rotation regulator 5, a control-limiting device (8 to 19) for the speed-of-rotation regulator is provided. The control-limiting device automatically adjusts the control limit of the speed-of-rotation regulator upon idling as a function of the setting current given off by the speed-of-rotation regulator and sets the maximum setting current at a value lying a predetermined amount above the idle setting current.

8 Claims, 3 Drawing Figures

DEVICE FOR ELECTRIC REGULATION OF IDLE OF INTERNAL COMBUSTION ENGINES

BACKGROUND OF THE INVENTION

The present invention relates to a device for electrically controlling the idling of internal combustion engines, particularly in automotive vehicles having a comparator in which an idling speed-of-rotation/control deviation signal is formed which, with a speed-of-rotation regulator, controls a setting current which can be fed into an idle airflow setting member, and having means for adjusting the setting current.

In such devices assurance must be had that a minimum flow of air is fed in all cases to the internal combustion engine so that satisfactory stability of regulation and thus a dependable interception is obtained in the case of so-called sudden "zero" gas. The minimum airflow depends on the specific type of internal combustion engine to be regulated and on variables which change with time, such as dirtying of the throttle-valve region and of the setting member in a by-pass to the throttle valve, and a change in the frictional resistance of the engine. Furthermore, for example, changes in air temperature and air pressure affect the minimum airflow required. If the minimum airflow is not reached even in the most unfavorable case then there is the danger that in the case of sudden "zero" gas, i.e. upon sudden release of the gas pedal, the internal combustion engine will stall as a result of its inertia and the speed-of-rotation of the internal combustion engine will drop below a lower limit value.

Up to now, the minimum airflow has been adjusted as a function of the type of engine by a so-called first adjustment point of a setting member in the by-pass to the throttle valve. This was done, for instance, by adjustment via an adjustment screw on the setting member. This process required a large amount of time. Another possible way of preestablishing the minimum airflow consisted of adjusting the setting members prior to installation by statistical determination of the required minimum airflows for a given type of engine. This adjustment, however, increased the cost of manufacture of the device for the electric control of the idling. Aside from this, in both methods of adjustment a future change in the required minimum airflow could, in principle, not be taken into account.

In the last-mentioned method of adjustment, the minimum airflow was adjusted in particular by an electric setting member on the speed-of-rotation regulator, or a voltage-current transformer arranged behind it. In this way, the setting current feeding a setting member could not exceed the preset value. In this case one starts, for instance, from the basis that the maximum value and/or minimum value of the setting current sets the minimum flow of air with the setting member.

It is an object of the invention to develop a device for electric regulation of the idling speed of the aforementioned type in such a manner that the necessary minimum airflow is assured without time-consuming and costly adjustment processes upon the manufacture of the device for the idling regulation and/or of the vehicle even in the event of a subsequent change in the operating conditions of the internal combustion engine.

SUMMARY OF THE INVENTION

According to the invention, in order to influence the control limit of the speed-of-rotation regulator there is connected to the latter a control limiting device (8 - 19) which adjusts itself as a function of the setting current upon idling and which limits the maximum setting current to a value which is a predetermined amount (desired distance A) above the idling setting current.

In accordance with the principle of the invention, the minimum airflow is automatically set upon idling operation of the internal combustion engine and checked—and, if necessary, corrected—upon each subsequent state of idling. For this purpose there is used the control limiting device which is connected with the speed-of-rotation regulator in order to influence its control limit. In the control limiting device a comparison is effected between the idling setting current at the regulator output, which current sets itself to a steady value in the idling state, and a limitation signal formed by the control limiting device, a desired distance or safety distance from the steady-state idling setting current and the control limit being taken into account. In this, way the regulator can, if necessary, give off a somewhat smaller setting current than the steady-state idling setting current.

The advantages of this device therefore consist essentially in the fact that the minimum airflow which is made possible by the setter is adjusted, without cumbersome and time-consuming adjusting processes, to the actual value required in accordance with the type of engine and on basis of the other operating parameters, and is brought up to date. In this way it is now also possible to manufacture standardized devices for the electric regulation of idling for a large number of types of engines without setting and adjustment processes specific to each type. Manufacture and stocking are therefore considerably facilitated.

The device is developed to particular advantage, in the same way as the customary idling regulator, with electric means which are preferably arranged in the manner that the control limiting device comprises an automatically adjustable, storing limiting signal transmitter (9) which acts, possibly via a comparison unit (10) into which a setting-current signal can be fed, on a control limiter (11) and is fed back, via another comparison unit (12) into which the setting-current signal can be fed, with the inclusion of means for the formation of the desired distance upon each true idling state. There is essential in this connection the automatically settable, storing limitation signal transmitter which is automatically so regulated as a function of the setting current occurring in the idling state, with due consideration of the desired distance between idling-speed setting current and maximum setting current, that it acts via the control limiter on the speed-of-rotation regulator in such a manner as to establish the maximum setting current. The limitation signal transmitter therefore stores an automatically set value of the limitation signal.

By a direction discriminator (15) for determining the trend of adjustment of the limitation signal transmitter, which is arranged in the feedback branch between the further comparison unit (12) and the automatically settable, storing limitation signal transmitter (9), the size of the limitation signal is automatically controlled depending on existing conditions so as to increase or reduce same.

It is essential that the automatically settable limitation signal transmitter is automatically adjusted only in a so-called true idling state, as a function of the setting current reached in this state. For the recognition of the true idling state, a discriminator (19) is further provided according to the invention in order to activate the setting of the limitation signal transmitter (9). This discriminator (19) is particularly advantageous to form the switch function which recognizes the true idling state $$LL = V \cdot DK$$

in which
LL is true idling state
$\overline{V}$ is vehicle speed zero
$\overline{DK}$ is throttle valve closed
and, with greater precision $$LL = V \cdot T \cdot DK \cdot KK \cdot MT$$

in which
LL is true idling state
$\overline{V}$ is vehicle speed zero
T is no changes in setting current (setting value changes) within a predetermined time
$\overline{DK}$ is throttle valve closed
$\overline{KK}$ is air-conditioner compressor off
MT is engine warm.

In this way, the minimum airflow to be obtained under the most unfavorable operation is set with great precision as a function of the quantity of air actually necessary when idling. Falsification of the minimum airflow by an internal combustion engine which is not yet sufficiently warm or by connected accessory units—air-conditioner compressor—are avoided. Furthermore, the setting of the minimum airflow is not affected if, to be sure, the gas pedal is not actuated—as would correspond to the normal case of idling—but the internal combustion engine is relieved from load or driven by the travelling vehicle. Furthermore, even slight changes in throttle valve are recognized by the driver, particularly upon maneuvering, so that the influence of an arbitrary change in the throttle valve on the minimum airflow is also eliminated.

The advantageous desired distance (A) between the control limit of the speed-of-rotation regulator and the idle speed setting current in the true idling phase is formed in the manner that an additive fixed-value transmitter (14) is arranged between the output of the limitation signal transmitter (9) and the additional comparison unit (12). The fixed-value transmitter in the signal-flow direction in front of the further comparison unit provides that the limitation signal transmitter is automatically set to a value which is lower by the fixed value than the idle setting current which is also fed into the further comparator.

The control limiter (11) itself, which practically represents a setting member acting on the speed-of-rotation regulator to change the control limit thereof is advisedly developed as regulator amplifier with proportional plus integral plus derivative (PID) time response in order to obtain a rapid but stable change in the control limit.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF A PREFERRED EMBODIMENT

Figure 1:
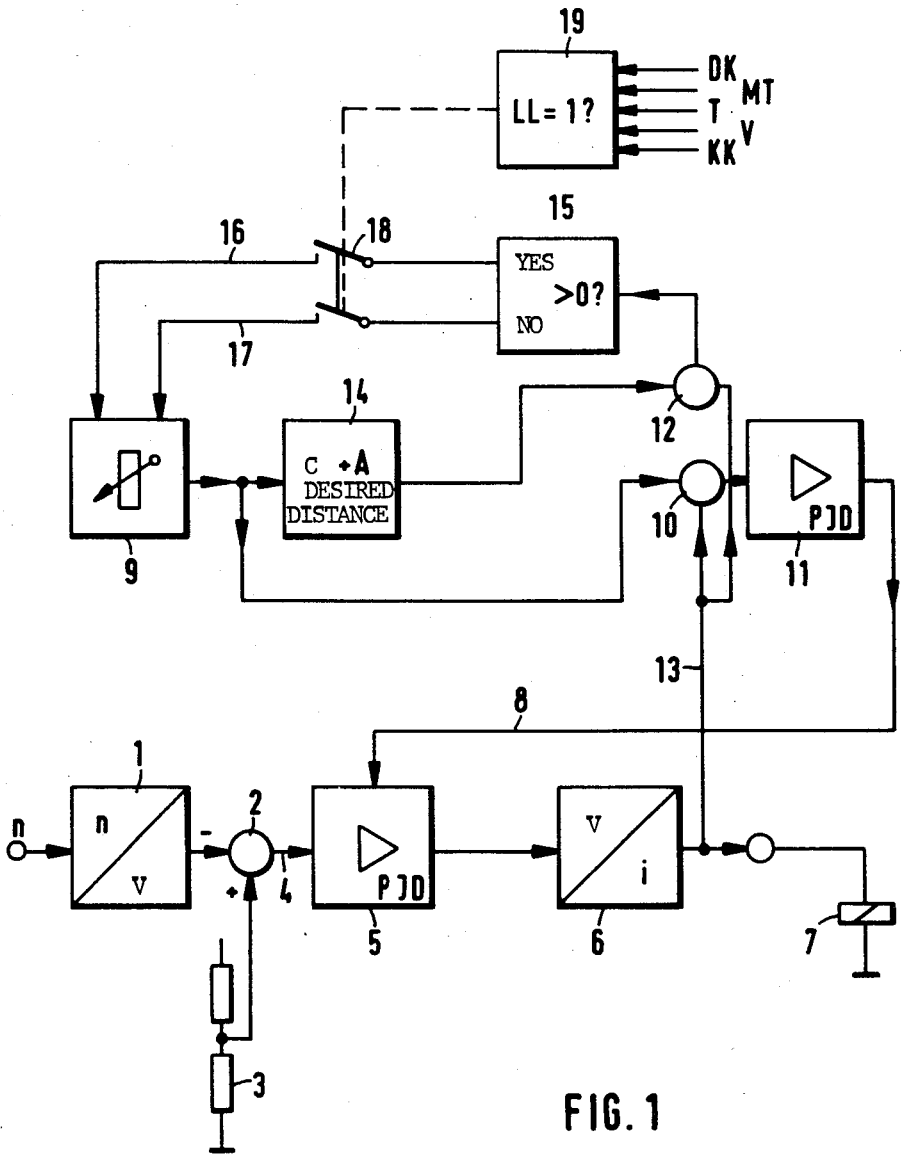
FIG. 1 is a block diagram of the device.

In FIG. 1, 1 is a speed-of-rotation voltage transformer which transforms the speed-of-rotation of a combustion engine (not shown) into a proportional voltage. In the signal-flow direction the speed-of-rotation voltage transformer is followed by a comparison unit 2. From the actual speed-of-rotation signal which is given off by the speed-of-rotation voltage transformer 1 and a desired speed-of-rotation signal which is defined by a speed-of-rotation desired-value transmitter 3, the comparison unit 2 forms a control deviation signal on a line 4. Via the line 4, the idle speed-of-rotation deviation signal is fed into a speed-of-rotation regulator 5 of PID response. An output variable of the speed-of-rotation regulator is converted via a voltage-current transformer 6 into a setting current which corresponds to the idle speed-of-rotation control deviation signal, said setting current being fed into a setting device 7. The setting device 7 lies in a bypass to a throttle valve of an internal combustion engine.

Figure 2:
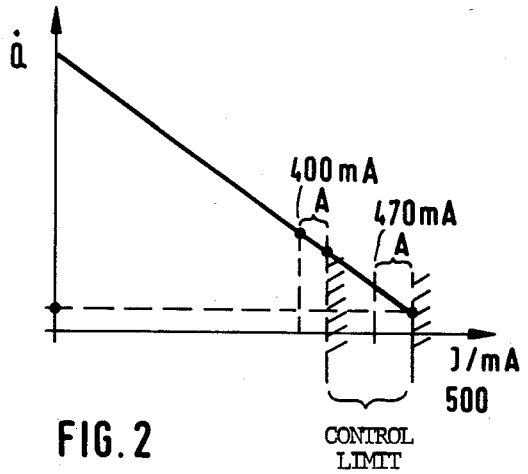
FIG. 2 is a regulator characteristic curve.

FIG. 2 shows an ordinary characteristic curve of the setting device 7, the curve showing the dependence of the airflow Q through the setting device as a function of the setting current in the setting device 7. It can be noted from FIG. 2 that a minimum value of the idle setting current results in the maximum value of the airflow Q, while larger setting currents result in smaller airflows Q in accordance with a linear characteristic. In addition to this, FIG. 2 shows that the control limit of the regulation amplifier is so set that the maximum value of the setting current of, for instance, 500 mA is greater than the corresponding setting current upon true idling, which amounts, for instance, to 470 mA. The distance A between these two setting currents is the so-called desired or safety distance.

A device for influencing the control limit of the speed-of-rotation regulator acts on the latter via a line 8.

For this purpose, a signal is fed by an automatically adjustable, storing limitation signal transmitter 9, via a comparison unit 10, into a control limiter 11. The control limiter is developed as PID control amplifier and feeds a limitation signal into the line 8.

The comparison unit 10, as well as another comparison unit 12, is acted on via a line 13 with a signal corresponding to the setting current. Furthermore, the further comparison unit 12 receives an additive fixed-value signal from a fixed-value transmitter 14 which produces the desired distance between the control limit and the setting current upon true idling. A comparison signal at the output of the comparison unit 12, which comes from the size of the signal from the limitation signal transmitter 9 which (size) is increased by the fixed value of the fixed-value transmitter 14, is fed into a discriminator 15 for recognition as to whether the value stored in the limitation signal transmitter 9 is to be increased or reduced, corresponding to the signal of the setting current on the line 13, namely lines 16, 17.

The limitation signal transmitter is indicated symbolically as a variable resistor which can form a voltage signal corresponding to a displacement by electric motor of the wiper. An electric motor—not shown—is in this connection driven by signals on one of the lines 16, 17 corresponding to one of its two possible directions of rotation.

An automatic change in the storing limitation signal transmitter, however, takes place only when a switch 18 is closed. This switch is only closed when a case of true idle operation is present, as recognized by a discriminator 19. For this purpose, the discriminator 19 comprises networks which act on the signal in accordance with the throttle-valve position DK, in accordance with the heat of the engine MT, in accordance with a change in setting current within a predetermined time T, in accordance with the speed of the vehicle V and in accordance with the attachment of an auxiliary unit KK. The discriminator forms a switch function for the recognition of the true idling state LL, namely:

$$LL = V \cdot T \cdot DK \cdot KK \cdot MT$$

in which

LL is true idling state $\overline{V}$ is speed of vehicle zero

T is no changes in setting current (changes in setting values) within a predetermined time $\overline{DK}$ is throttle valve closed $\overline{KK}$ is air-conditioner compressor off MT is engine warm.

If a true idling state is recognized, corresponding to the condition LL=1, then a signal is formed from the existing setting current signal and the previously stored value (variable) in the limitation signal transmitter plus the desired-distance—fixed-value transmitter 14—in the additional comparison unit 12, which signal changes the value stored in the limitation signal transmitter 9 in the manner that the signal given off corresponds to the signal of the idle setting current reduced by the desired distance. The final limitation signal for influencing the control limit of the speed-of-rotation regulator 5 is derived from this signal, as has been described above.

Figure 3:
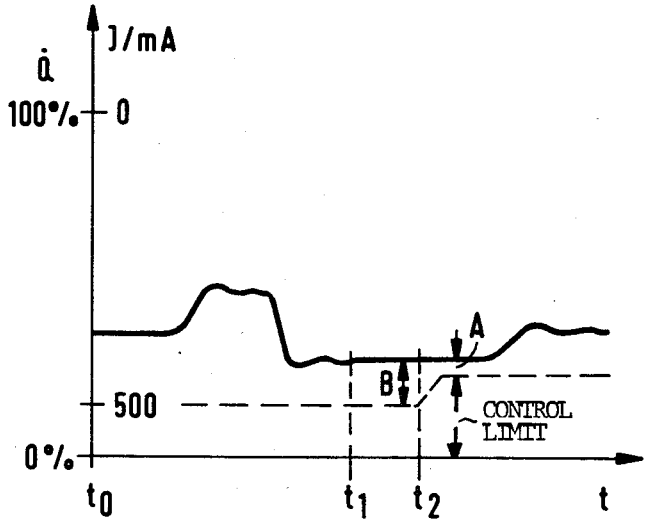
FIG. 3 shows the variation with time of a typical setting current.

In FIG. 3, the time is plotted on the horizontal axis and the setting current and setting member opening in the bypass are plotted on the vertical axis. A setting device opening of 100% corresponds in this connection to a setting current of 0 mA. The solid line shows the variation with time of the setting current and the inverse course of the setting-member opening, while the dashed line indicates the limitation of the regulator control, also known as regulation limit. From FIG. 3 it can be noted how, at the time $t_0$, the setting-device opening has assumed a given value in order to maintain the idle speed-of-rotation of an internal combustion engine at a value predetermined by the desired idling speed-of-rotation. Shortly thereafter, the setting device is opened further by the connection of the auxiliary unit. At the time $t_1$ the setting-device opening drops to a value which already corresponds to the case of true idling operation. The discriminator 19, however, recognizes the state of true idling operation only after a predetermined period of time, after which it can be certain that the gas pedal has not been intentionally moved by the driver. After expiration of the period of time $\tau$ at the time $t_2$ the condition LL=1 is satisfied and an adjustment of the control limit of the regulator amplifier can take place. For this purpose it is assumed, corresponding to the dashed line, that the old regulator limit corresponding to the distance B at the time $t_2$ was initially too large so that the control limitation device must now automatically increase the regulator limit to the value A. The desired distance can, however, also be lowered in the reverse direction if, for instance, due to a decrease in the frictional resistance of the internal combustion engine which has occurred in the course of time, a smaller airflow is sufficient in order to reach the desired idle speed-of-rotation. The self-adjustment can therefore take place—controlled by the discriminator 15—in both directions. The device for the electric regulating of the idling speed is thus practically always optimally set.

I claim:

1. In a device for electrically controlling the idling of internal combustion engines, particularly in automotive vehicles having an idle flow setting element, a comparator wherein an idling speed-of-rotation/control deviation signal is formed, and a speed-of-rotation regulator, and wherein the comparator and the regulator control a setting current which can be fed into the idle airflow setting element, the device having means for adjusting the setting current, the improvement wherein the device further comprises a control limiting unit which adjusts itself as a function of the setting current upon idling and which limits the maximum setting current to a value which is a predetermined amount above the idling setting current, said control limiting unit being connected to the regulator.

2. The device according to claim 1, wherein said control limiting unit comprises:

an automatically adjustable, signal transmitter including means for storing a limiting signal;

a first comparison unit into which a setting-current signal can be fed;

a control limiter; and a second comparison unit into which the setting-current signal can be fed; and means for the formation of a desired idle offset upon each true idling state; and wherein said signal transmitter acts via said first comparison unit on said control limiter, and acts via said second comparison unit and said formation means to generate a feedback signal along a feedback path to said transmitter.

3. The device according to claim 2, further comprising a direction discriminator for determining the trend of adjustment of the limitation signal transmitter, said discriminator being coupled in a feedback branch between the second comparison unit and the signal transmitter, and wherein the feedback signal is a limitation signal automatically controlled by said formation means depending on existing conditions so as to increase or reduce same.

4. The device according to claim 2, wherein said formation means includes a discriminator for the recognition of the true idling state, said discriminator activating the setting of the signal transmitter.

5. The device according to claim 4, wherein said formation means with said discriminator provides a switch function which recognizes the true idling state $$LL = V \cdot DK$$

in which

LL is true idling state $\overline{V}$ is vehicle speed zero $\overline{DK}$ is throttle valve closed.

6. The device according to claim 5, wherein said formation means with said discriminator provide an idling state with greater precision $LL = \overline{V} \cdot T \cdot \overline{DK} \cdot \overline{KK} \cdot MT$ in which LL is true idling state $\overline{V}$ is vehicle speed zero T is no changes in setting current within a predetermined time $\overline{DK}$ is throttle valve closed $\overline{KK}$ is air-conditioner compressor off MT is engine warm.

7. The device according to claim 2, further comprising an additive fixed-value transmitter connected between the output of said limitation signal transmitter and said second comparison unit in order to form an idle offset between the control limit of the speed-of-rotation regulator and the idle speed setting current in the true idling phase.

8. The device according to claim 2, wherein said control limiter is formed as a regulator amplifier with proportional plus integral plus derivative (PID) time response.

* * * * *